US008163117B2

(12) United States Patent
Nagao et al.

(10) Patent No.: US 8,163,117 B2
(45) Date of Patent: Apr. 24, 2012

(54) PRODUCING METHOD OF BALL FOR BALL GAME

(75) Inventors: Yukinori Nagao, Hiroshima (JP); Hidesuke Kuriki, Hiroshima (JP)

(73) Assignee: Molten Corporation, Hiroshima-Shi (JP)

( * ) Notice: Subject to any disclaimer, the term of this patent is extended or adjusted under 35 U.S.C. 154(b) by 28 days.

(21) Appl. No.: 11/497,517

(22) Filed: Aug. 2, 2006

(65) Prior Publication Data

US 2008/0029203 A1 Feb. 7, 2008

(51) Int. Cl.
*B32B 37/00* (2006.01)

(52) U.S. Cl. ..... 156/156; 156/171; 156/172

(58) Field of Classification Search ..... 156/171, 156/172, 169, 156; 473/605
See application file for complete search history.

(56) References Cited

U.S. PATENT DOCUMENTS 2,378,336 A * 6/1945 Sopp ..... 69/1
2,537,982 A * 1/1951 Finn ..... 524/291
5,772,545 A 6/1998 Ou ..... 473/605
6,793,597 B2 * 9/2004 Awan ..... 473/605
2003/0073527 A1 4/2003 Ou

FOREIGN PATENT DOCUMENTS

CN 1387471 12/2002
CN 1411880 4/2003

OTHER PUBLICATIONS

Chinese Office Action issued for corresponding Chinese Patent Application No. 200710143457.8 dated Dec. 5, 2011.

* cited by examiner

*Primary Examiner* — Jeff Aftergut
(74) *Attorney, Agent, or Firm* — Kratz, Quintos & Hanson, LLP

(57) ABSTRACT

A producing method of ball for ball game including a ball cover and a bladder is disclosed. The method includes steps of (a) inflating a bladder and providing a web layer by coating at least a thread on an outer surface of the bladder thereafter, (b) fabricating a plurality of panels in a predetermined shape, (c) sewing the plurality of panels edge to edge together excluding a portion thereof by a sewing machine to form a ball cover including an inlet opening, (d) inserting the bladder obtained at step (a) into the ball cover obtained at step (c) through the inlet opening, (e) sewing the inlet opening of the ball cover, and (j) inflating the ball for ball game to a predetermined pressure within a shaping mold.

2 Claims, 1 Drawing Sheet

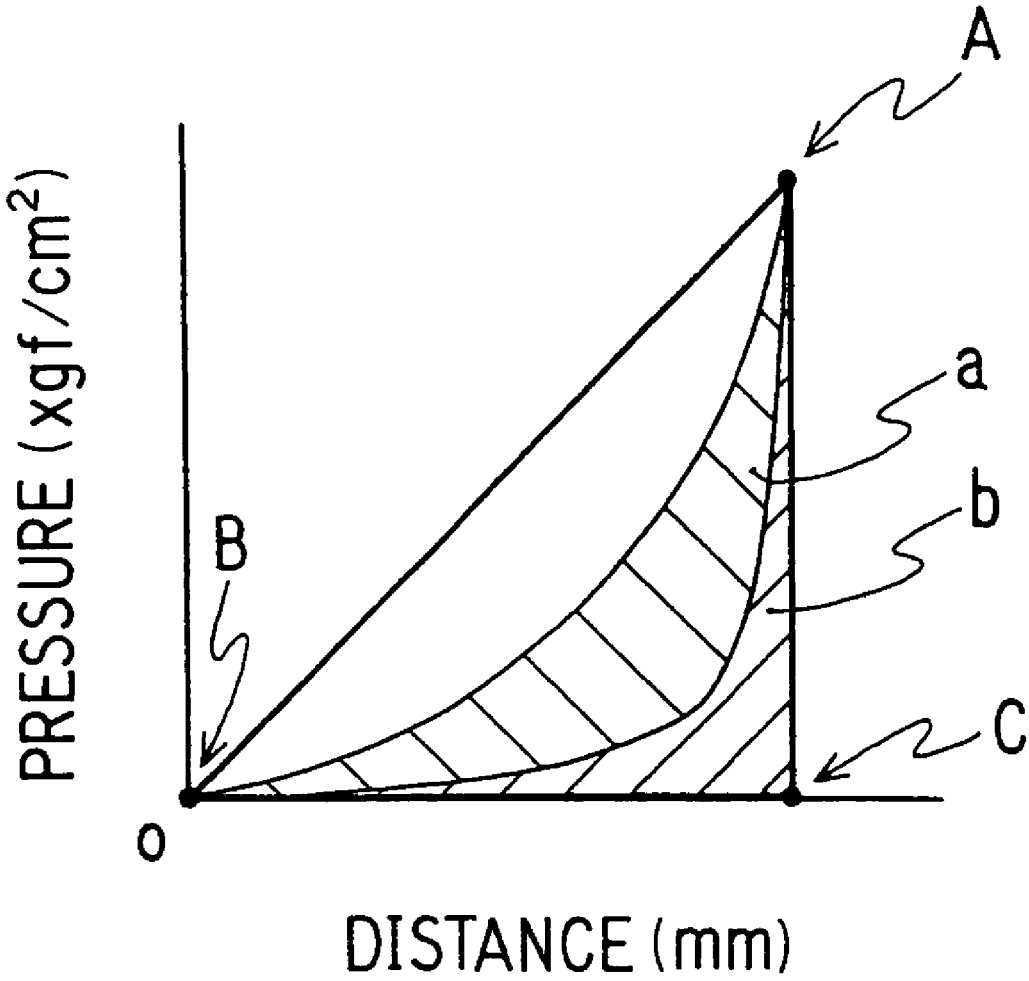
A
a
b
B
C
o
PRESSURE (xgf/cm²)
DISTANCE (mm)

PRODUCING METHOD OF BALL FOR BALL GAME

BACKGROUND OF THE INVENTION

The present invention relates to a producing method of ball for ball game.

A soccer ball or volleyball is generally made up by a ball cover and a bladder disposed within the ball cover. The ball cover is made of leather, synthetic leather such as polyurethane (PU) or polyvinyl chloride (PVC) or laminated material. The synthetic leather is composed of an outer coating layer, an intermediate forming layer and an inner lining layer to strengthen and support the intermediate forming layer. The bladder is a spherical rubber ball having a valve stem attached thereon.

The leather or synthetic leather is cut into a plurality of panels with a predetermined shape. For a soccer ball, the most common shape of panel is pentagon and hexagon. In other words, the ball cover of a soccer ball is generally made of 12 pieces of pentagonal panels and 20 pieces of hexagonal panels by sewing edge to edge. The spherical ball cover of a volleyball is made of 18 pieces of rectangular panels by sewing to edge, for example. An inflatable bladder is disposed inside the ball cover and its valve stem is extended outside the ball cover for air inflation. When air is pumped into the bladder through the valve stem, the air inflates the bladder to prop up the ball cover and retain its roundness. Therefore, the more air is inflated into the bladder, the sportsball has a better bounce.

The invention with an object of providing a sportsball which supports the ball cover by a reinforced bladder is disclosed in U.S. Pat. No. 5,772,545.

The sportsball disclosed in U.S. Pat. No. 5,772,545 includes a ball cover and a bladder. The ball cover has a valve hole provided thereon and consists of a plurality of panels connected edge to edge by a sewing machine to form a roundness shape. Each of the panels has a predetermined shape and is made of synthetic leather. The synthetic leather has an outer coating layer, an inner lining layer, and an intermediate layer which is integrally formed between the outer coating layer and the inner lining layer and is strengthened and supported by the inner lining layer. The bladder disposed within the ball cover includes a bladder ball made of rubber, an exterior web layer integrally attached on a predetermined area of an outer surface of the bladder ball and a valve stem which is mounted on the bladder ball and is extended through the valve hole of the ball cover connected thereto for air inflation. The web layer includes at least an elongated strengthened thread evenly wound around the entire outer surface of the bladder ball. The strengthened thread is overlapped to form the web layer to entirely embrace the bladder ball for supporting the bladder ball and resisting the stress and impact force applied to the sportsball. The panels of the ball cover may also be made of thin leather with a pad layer adhered underneath for providing the softness and thickness of the ball cover.

The manufacturing method disclosed in U.S. Pat. No. 5,772,545 includes following steps:

(a) Inflate a rubber bladder ball having a valve stem provided thereon.

(b) Coat at least an elongated strengthened thread such as nylon threads with an adhesive agent (or glue)

(c) Wind the nylon thread evenly around an outer surface of the rubber bladder ball until the bladder ball is embraced by a web layer of the nylon thread to form a strengthened bladder.

(d) Heat the bladder in a mold until the web layer is permanently and rigidly united with the outer surface of the bladder ball.

(e) Cut a ball cover material (for example, leather or synthetic leather including a sponge material made of foaming polyurethane or polyvinyl chloride) into a predetermined number of panels in a predetermined shape (12 pieces of pentagonal panels and 20 pieces of hexagonal panels are cut for a soccer ball, and 18 pieces of panels in two kinds of rectangular shape are cut for a volleyball).

(f) Sew the panels edge to edge together by a sewing machine to form a ball cover which has a valve hole provided thereon (a section of the panels are not sewn together to form an inlet opening at this stage).

(g) Heat the ball cover and turn the ball cover right side out.

(h) Insert the strengthened bladder into the ball cover through the inlet opening.

(i) Align and apply adhesive agent (or glue) on the valve stem of the bladder with the valve hole of the ball cover.

(j) Semi-inflate the bladder to make sure that the inflated bladder would prop against the ball cover.

(k) Sew the inlet opening of the ball cover together by hand.

(l) Fully inflate the sportsball to more than a standard pressure within a shaping mold to ensure a permanent structure and shape of the bladder and ball cover.

According to the invention disclosed in U.S. Pat. No. 5,772,545, in order to solve the problem of providing a sportsball for supporting the ball cover with the strengthened bladder, step (d) "Heat the bladder in a mold until the web layer is permanently and rigidly united with the outer surface of the bladder ball" and step (g) "Heat the ball cover and turn the ball cover right side out" must be included. Accordingly, there has been a problem in safety (in other words, it is dangerous) besides the problems of complex manufacturing steps and requiring facility for heating adhesive agent.

SUMMARY OF THE INVENTION

Objects of the present invention are to mitigate problems with the invention disclosed in U.S. Pat. No. 5,772,545 and to provide a producing method of ball for ball game which does not include the step of heating the bladder in a mold until the web layer is permanently and rigidly united with the outer surface of the bladder ball and the step of heating the ball cover and turning the ball cover right side out.

According to an aspect of the present invention, a producing method of ball for ball game includes steps of:

(a) inflating a bladder and providing a web layer by coating at least a thread on an outer surface of the bladder thereafter;

(b) fabricating a plurality of panels in a predetermined shape;

(c) sewing the plurality of panels edge to edge together excluding a portion thereof by a sewing machine to form a ball cover including an inlet opening;

(d) inserting the bladder obtained at step (a) into the ball cover obtained at step (c) through the inlet opening;

(e) sewing the inlet opening of the ball cover; and (j) inflating the ball for ball game to a predetermined pressure within a shaping mold.

According to another aspect of the present invention, a producing method of ball for ball game includes steps of:

(k) inflating a bladder having a valve stem thereon;

(l) coating the bladder with at least an elongated thread;

(m) winding the reinforcing thread evenly around an outer surface of the bladder until the bladder is embraced by a web layer of the reinforcing thread to form the reinforced bladder;

(n) cutting a ball cover material into a plurality of panels in a predetermined shape;

(o) sewing the plurality of panels edge to edge together by a sewing machine to form a ball cover having a valve hole provided thereon and forming an inlet opening by not sewing a portion of the plurality of panels;

(p) inserting the reinforced bladder into the ball cover through the inlet opening;

(q) aligning the valve stem of the bladder with the valve hole of the ball cover to apply an adhesive agent;

(r) mid-inflating the bladder;

(s) sewing the inlet opening of the ball cover together by hand; and (t) inflating the ball for ball game to more than a standard pressure within a shaping mold.

According to the producing method of ball for ball game (hereinafter, referred to as producing method) of the present invention, it is not included the step of heating the bladder in a mold until the web layer is permanently and rigidly united with the outer surface of the bladder ball and the step of heating the ball cover and turning the ball cover right side out. Therefore, simple production steps can be obtained and facility for heating adhesive agent is not required, thereby safety issues are not raised.

Moreover, it is advantageous that a ball with soft touch can be obtained since a ball is air dried without heating the bladder after the step of winding the reinforcing thread evenly around an outer surface of the bladder until the bladder is embraced by a web layer to form a strengthened bladder.

Furthermore, it is advantageous that degradation of the thread can be prevented since there is no heating step.

BRIEF EXPLANATION OF THE DRAWING

FIG. 1 is a graph showing the relationship between the internal pressure and deformation amount (distance) of a ball used for calculating compression hardness, compression energy and compression restoring property of a ball.

BEST MODE FOR CARRYING OUT THE INVENTION

A producing method of ball for ball game according to the present invention includes following steps:

Step I: Inflate a bladder provided with a valve stem.

Step II: Coat the bladder with at least an elongated thread.

Step III: Form a reinforced bladder by winding the reinforcing thread evenly around an outer surface of the bladder until the bladder is embraced by a web layer.

Step IV: Cut a ball cover material, for example natural leather, synthetic leather including a sponge material made of forming polyurethane or polyvinyl chloride or laminated material, into a predetermined number of panels in a predetermined shape. At step IV, 12 pieces of pentagonal panels and 20 pieces of hexagonal panels are cut for a soccer ball, and 18 pieces of panels in two kinds of rectangular shape are cut for a volleyball.

Step V: Sew the panels edge to edge together by a sewing machine to form a ball cover which has a valve hole provided thereon. A section of the panels are not sewn together to form an inlet opening at this step.

Step VI: Turn the ball cover right side out and insert the reinforced bladder into the ball cover through the inlet opening.

Step VII: Align and adhere the valve stem of the bladder with the valve hole of the ball cover.

Step VIII: Semi-inflate the bladder to make sure that the bladder would prop against the ball cover.

Step IX: Sew the inlet opening of the ball cover together to form the ball for ball game.

Step X: Fully inflate the ball for ball game to more than a standard pressure within a shaping mold to ensure a permanent structure and shape of the bladder and ball cover.

In the same manner as in the sportsball disclosed in U.S. Pat. No. 5,772,545, a primary stress supporting portion of the ball for ball game of the present invention is the reinforced bladder having flexibility and impact resistance.

Accordingly, the ball for ball game is advantageous in that the ball cover enables not only reducing the impact of a header but also reducing the impact of kicking a ball with a foot.

In the ball for ball game according to the present invention, the portion which supports the stress and bears the impact is also the reinforced bladder. Therefore, expensive leather panels and laminated material of the ball cover may be formed thinner in order to decrease costs.

The present invention is further explained by way of examples. However, the present invention is not limited to such examples.

EXAMPLE

Five samples of the ball for ball game were manufactured in accordance with the producing method of the present invention, and compression hardness (LC), compression energy (WC) and compression restoring property (RC) were calculated by utilizing a handy compression testing machine. With respect to the compression hardness (LC), compression energy (WC) and compression restoring property (RC), LC is obtained by dividing the sum of the areas of region a and region b by the area of a triangle ABC in the graph of FIG. 1, WC is obtained by summing the areas of region a and region b in the graph of FIG. 1, and RC is obtained by dividing the area of region b in the graph of FIG. 1 by the sum of the areas of region a and region b and multiplying by 100. With respect to LC it is determined that the hardness increases as the value approaches to 1, with respect to WC it is determined that the ball is likely to be compressed with the increase in value, and with respect to RC it is determined that there is increased restoring property as the value approaches to 100%.

The calculated result is shown in Table 1.

COMPARATIVE EXAMPLE

Five samples were manufactured in accordance with the manufacturing method disclosed in U.S. Pat. No. 5,772,545, and compression hardness (LC), compression energy (WC) and compression restoring property (RC) were calculated by utilizing a handy compression testing machine in the same manner as the above-described example.

The calculated result is shown in Table 1.

TABLE 1

| Measuring item | Measuring method | Data obtained by measurement with ball | Data obtained by measurement with web bladder (average of n = 5) |
|---|---|---|---|
| Rebound | Measure the height of rebound with 2 m free fall | Example: 143 cm<br>Comparative Example: 138 cm | Example: 154 cm<br>Comparative Example: 148 cm |
| Impact value (kgf) | Measure impact value when ball hits the ground with 1 m free fall: An index indicating softness when ball hits the ground (softer as the value decreases) | Example: 55.9<br>Comparative Example: 57.5 | Example: 43.3<br>Comparative Example: 45.6 |

TABLE 1-continued

| Measuring item | Measuring method | Data obtained by measurement with ball | Data obtained by measurement with web bladder (average of n = 5) |
|---|---|---|---|
| Compression energy (gfcm/cm$^2$) | Compression energy when load of 5 kgf is applied with 2 cm$^2$ pressurized area (work load): An index indicating softness when ball is pressed with finger (softer as the value increases) | Example: 8.2<br>Comparative Example: 7.9 | |
| Compression restoring property (gfcm/cm$^2$) | Increased restoring property as the value approaches to 100% | Example: 83.2<br>Comparative Example: 80.2 | |

What is claimed is:

1. A producing method of a ball for a ball game, comprising steps of:

(a) inflating a bladder and providing a web layer by coating at least a thread having an adhesive or glue on an outer surface of the bladder;

(b) drying the adhesive or glue by air without heating the bladder in a mold;

(c) fabricating a plurality of panels in a predetermined shape;

(d) sewing the plurality of panels edge to edge together excluding a portion thereof by a sewing machine to form a ball cover including an inlet opening;

(e) turning the ball cover right side out without heating the cover;

(f) inserting the bladder obtained at step (a) into the ball cover obtained at step (e) through the inlet opening of the cover;

(g) sewing the inlet opening of the ball cover; and (h) inflating the ball for a ball game to a predetermined pressure within a shaping mold.

2. A producing method of a ball for a ball game, comprising steps of:

(a) inflating a bladder having a valve stem thereon;

(b) coating an elongated thread, with an adhesive or glue to form a reinforcing thread;

(c) winding the reinforcing thread evenly around an outer surface of the bladder until the bladder is embraced by a web layer of the reinforcing thread;

(d) drying the adhesive or glue by air without heating in a mold;

(e) cutting a ball cover material into a plurality of panels in a predetermined shape;

(f) sewing the plurality of panels edge to edge together by a sewing machine to form a ball cover having a valve hole provided thereon and forming an inlet opening by not sewing a portion of the plurality of panels;

(g) turning the ball cover right side out without heating the cover;

(h) inserting the bladder into the ball cover through the inlet opening of the cover;

(i) aligning the valve stem of the bladder with the valve hole of the ball cover with the use of an adhesive agent;

(j) inflating the bladder at a pressure lower than a predetermined pressure;

(k) sewing the inlet opening of the ball cover together by hand; and (l) inflating the ball for a ball game to more than a standard pressure within a shaping mold.

* * * * *